US005784858A

United States Patent [19]

Lastovich et al.

[11] Patent Number: 5,784,858

[45] Date of Patent: Jul. 28, 1998

[54] DRAWER ACTION TRAY SEALING MACHINE

[75] Inventors: Mark S. Lastovich, Rockford; Perry R. DeYoung, Grand Rapids, both of Mich.

[73] Assignee: Oliver Products Company, Grand Rapids, Mich.

[21] Appl. No.: 629,269

[22] Filed: Apr. 8, 1996

[51] Int. Cl.[6] ..... B65B 7/28

[52] U.S. Cl. ..... 53/329; 53/329.2; 53/373.7; 53/390

[58] Field of Search ..... 53/329, 329.2, 53/478, 485, 287, 390, 373.7

[56] References Cited

U.S. PATENT DOCUMENTS

| | | | |
|---|---|---|---|
| 3,190,051 | 6/1965 | Souligney | 53/478 |
| 3,283,469 | 11/1966 | McBrady et al. | 53/485 |
| 3,724,161 | 4/1973 | Vermeulen | 53/329.3 |
| 4,583,350 | 4/1986 | Artusi et al. | 53/478 |
| 5,010,714 | 4/1991 | Medwed et al. | 53/373.7 |
| 5,331,791 | 7/1994 | Fux et al. | 53/373.7 |
| 5,345,747 | 9/1994 | Raque et al. | 53/373.7 |
| 5,379,572 | 1/1995 | Giovannone | 53/373.7 |
| 5,385,003 | 1/1995 | Nixon, Jr. | 53/485 |

OTHER PUBLICATIONS

Declaration of Mark S Lastovich regarding Experimental Units.

*Primary Examiner*—James F. Coan
*Assistant Examiner*—Gene L. Kim
*Attorney, Agent, or Firm*—Price, Heneveld, Cooper, DeWitt & Litton

[57] ABSTRACT

A container and lid sealing apparatus comprising a frame structure including a sealing position, support beams, a shiftable container support which includes a container retainer and shiftable on drawer rails from a position for loading and unloading a container into and out of the retainer, to the sealing position for sealing a lid on the tray, the drawer rails being vertically depressible with the container support, when under vertical force, to move it down onto the support beams, an upper heater platen suspended above the tray support, and an air actuator actuable to force the upper heater platen downwardly with force onto a container and lid on the support. The force is equally distributed on all portions of the platen to seal a lid onto a container. A cam switch is positioned to be actuated by the support in the sealing position for controlled activation of an air logic system to the actuator. A gas spring is connected between the support and frame for biasing the support toward the load-unload position, for ejection of the support upon deactivation of the air actuator.

9 Claims, 4 Drawing Sheets

DRAWER ACTION TRAY SEALING MACHINE

BACKGROUND OF THE INVENTION

This invention relates to a machine for sealing a lid on a container, as for sealing food or the like in the container.

Food containers used by fast food establishments, grocery stores, delicatessens and the like, when filled on site, commonly employ a tray-type container integrally connected to a cover or lid. These containers are handy but do not seal the food in or seal air out. Consequently spillage readily occurs and retention of freshness is not possible. Another type of common container is that which has a separate lid which is snapped into place between the specially formed lid and container. Some containers of this type are leak resistant, but do not totally seal the contents. In large food processing establishments, containers can be completely sealed utilizing sealing machines which are presently known, but these typically are complex apparatuses, not suitable for on-site use in fast food restaurants, grocery stores, and the like. Persons employed at fast food establishments and the like are frequently young, relatively unskilled persons who work at a rapid pace. Turnover rate of employees is generally high, resulting in a high level of inexperience. Therefore, any mechanical devices to be used to close and seal containers at these establishments should be simple, easy and safe to use. There is needed an apparatus which meets these criteria as well as providing a leakproof or leak resistant container which also preserves freshness of the food item.

One type of known apparatus usable in grocery stores, to seal a polymeric film lid onto the top rim of a container for containing and transporting food, uses a heated platen. If the tray is plastic, it can be made leakproof and airtight. If it is paperboard, it can be made leak resistant. The apparatus involves a fixed lower support serving as a tray carrier and having a well or cavity to receive and retain a container therein, and the upper heated platen pivotally mounted to shift to a closed position on the container and lid between the platen and the lower support. The heated platen is manually forced down and held down by the weight of the human operator onto the container and lid during a time period while heat is applied to seal the lid to the container.

However, in order to provide sufficient force on the container and lid to fully compress the periphery of the two together, the heated upper platen must be manually forced down by the operator with a significant force which is usually about 20–40 pounds. By using leverage-type mechanical advantage, the force applied to the container and lid can be about 75 pounds. This exertion is required for each tray and lid, and for a set time period, in order to force the platen and tray carrier fully together. Establishments which would use these units frequently employ teenage persons or ladies, so that applying this significant amount of force steadily on the platen is difficult, requiring considerable exertion, and is particularly tiring. Moreover, it has been determined that even the application of this much force is sometimes not sufficient to assure a complete seal of the lid periphery to the container periphery. To be certain of sealing, the force should actually be several times this amount. One of the variables that can prevent total sealing is the fact that the flange of the tray might not be of uniform thickness around its periphery, resulting in a poor seal at the thinner areas.

SUMMARY OF THE INVENTION

An object of this invention is to provide a container sealing device which is rapid in operation, simple to use, requires little skill and is safe. The sealing device is particularly suitable for fast food restaurants, grocery stores, delicatessens, meat markets and the like, to seal the contents of the container against leakage from the container, and preferably against air entry into the container. It rockingly adjusts automatically to apply equal pressure to all areas of the tray flange.

The sealing machine has a slide drawer which serves as a tray carrier on which a container and lid are placed and retained, the tray carrier being readily slidable on drawer rails into sealing position from a load-unload position. An upper heated platen is shiftable downwardly by an inflatable air actuator to apply a great force to the center of the heated platen and hence to the container and lid. The air actuator is actuated in response to shifting of the tray carrier into the sealing position, to apply this significant sealing force, but not on the rails. Adjustable air logic control causes constant application pressure by the heater platen for a specific controlled time. Downward force on the tray holder is against special support beams beneath the tray holder, and onto which the tray holder is downwardly forced. Upon release of air pressure from the air actuator, the tray holder lifts and a gas spring ejects the tray holder with the sealed container from the sealing position to the load-unload position. The gas spring can be automated to extend the tray holder immediately or after a short delay. Preferably a container lift is then actuated to enable ready gripping of the filled, sealed container.

These and other objects, advantages and features of the invention will become apparent upon studying the following specification in conjunction with the drawings.

DESCRIPTION OF THE PREFERRED EMBODIMENT

Figure 2:
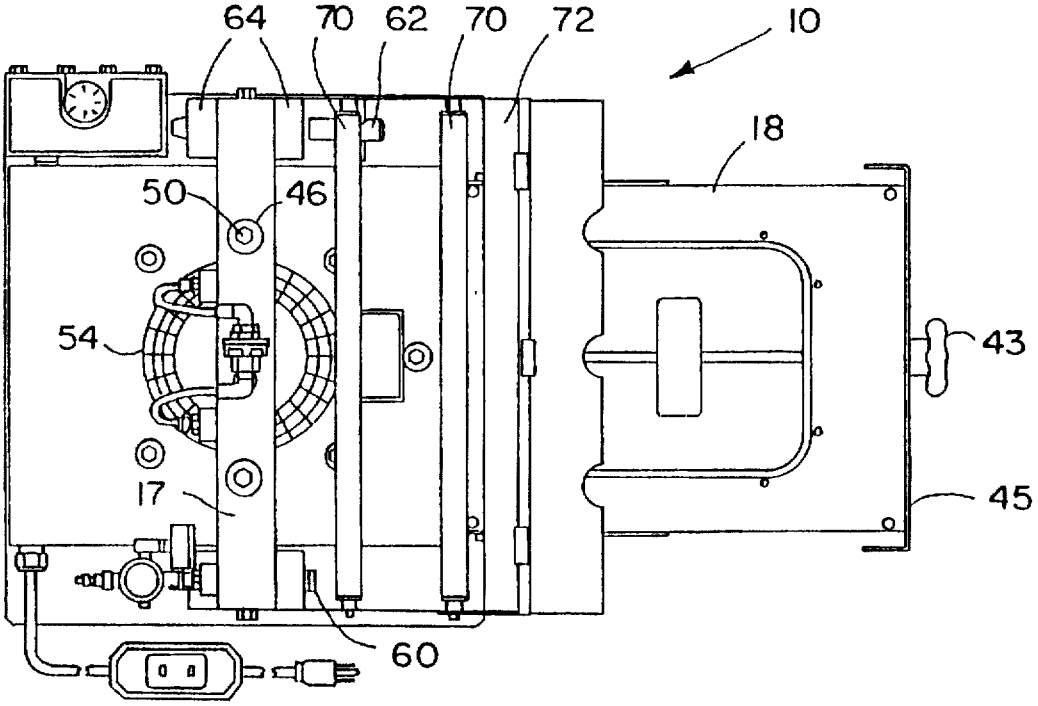
FIG. 2 is a top plan view of the apparatus.
Figure 1:
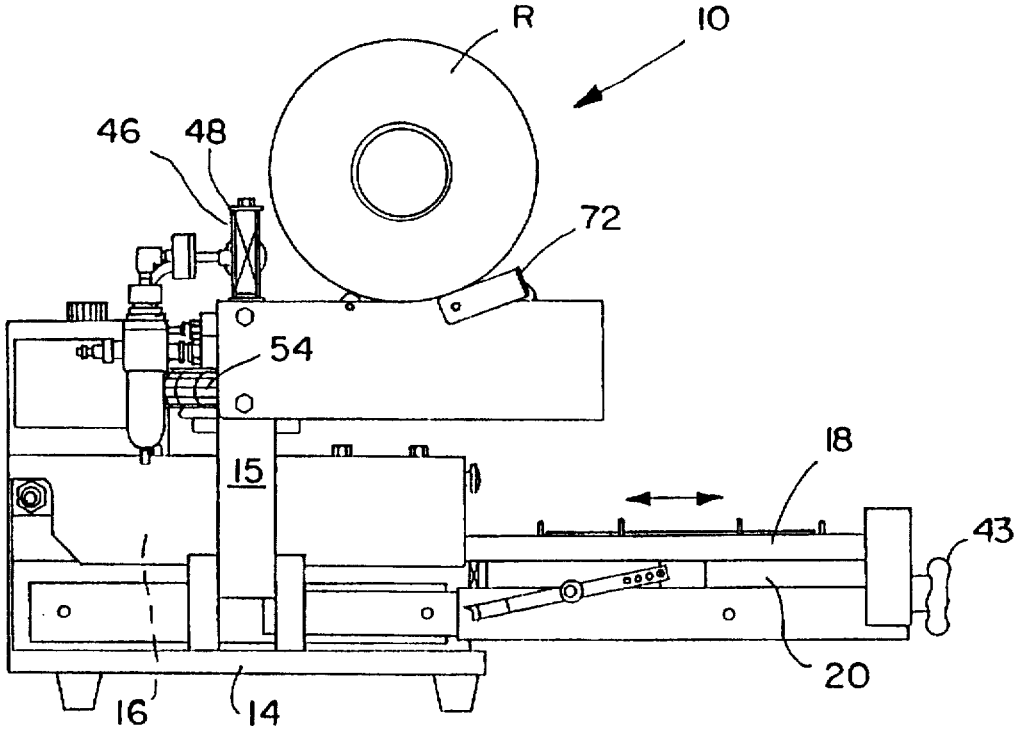
FIG. 1 is a side elevational view of the apparatus.

Referring specifically to the drawings, the novel apparatus 10 is shown having a support frame 14 which defines a sealing location or position 16 into which and out of which a lower tray support 18 can be moved. Tray holder 18 is indirectly mounted on a pair of drawer rails 20 (FIGS. 6 and 7) which telescopically cooperate with fixed case rails 22 for movement between the two positions, i.e., sealing position and load-unload position (FIG. 1). The drawer rails are actually attached to the inside faces of a pair of elongated bars 24. Tray holder 18 is mounted above and on bars 24 with upstanding pins or studs 26 (FIG. 7), resting on compression springs 28 around the pins. Downward force on tray holder 18 depresses it against the bias of springs 28, with movement on pins 26, until the tray holder abuts the top surfaces of stops in the form of a pair of elongated, upstanding, fixed, rigid beams 30 mounted to frame 14 and located at the sealing position. Beams 30 are parallel to bars 24. With this arrangement, the tray holder can be readily moved into and out of the sealing position on the drawer rails but, under significant downward force applied to the tray holder by the upper platen, the tray holder will be depressed against the bias of springs 28 onto these laterally spaced, parallel beams 30 which will supply support so as to prevent damage to the drawer rail assembly.

Tray holder 18 defines a desired number of container receiving cavities, shown here to be two, each cavity being surrounded by a peripheral ledge which is surrounded by a plurality of depressible locator pins 32. When a container having a peripheral shape like that of the cavity is placed therein, its peripheral, horizontal flange will rest on the peripheral ledge around the cavity, bounded by the pins 32. A lid of configuration like that of the container flange is placed thereon, also retained within locator pins 32 for alignment.

Figure 3:
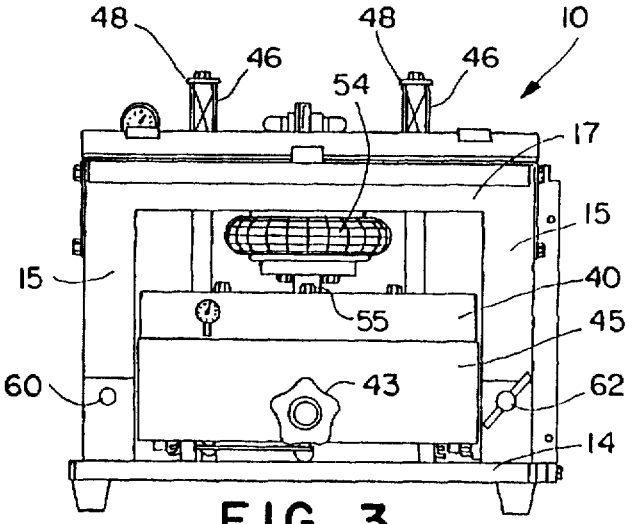
FIG. 3 is a front end elevational view of the apparatus.
Figure 5:
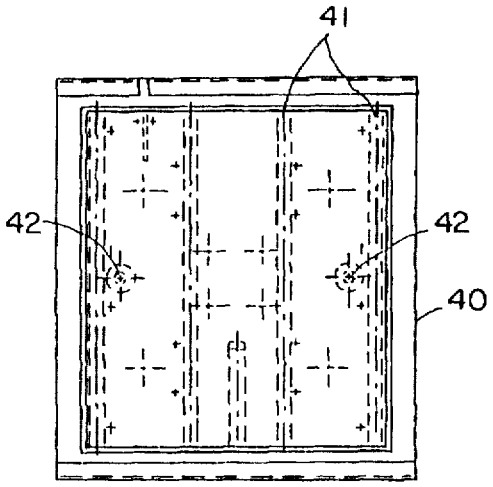
FIG. 5 is a bottom view of the upper platen.
Figure 4:
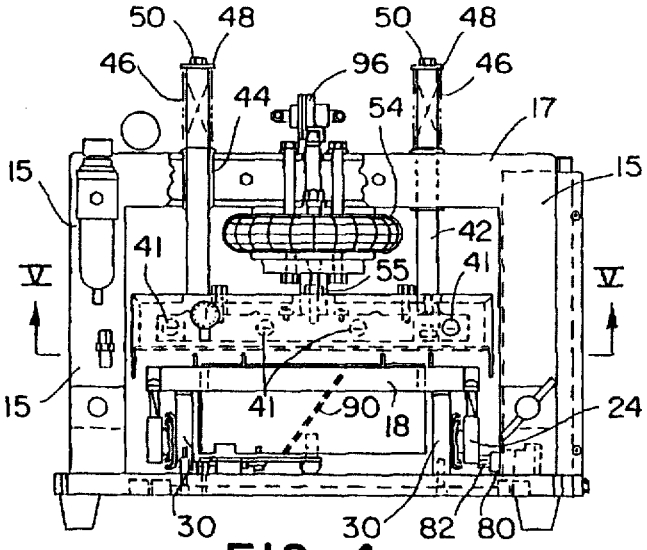
FIG. 4 is another front elevational view showing internal components.

At the sealing position is a heated upper platen 40 suspended on two laterally spaced rods 42. These rods are vertically slidable within sleeves 44 (FIG. 4) to be vertically movable. Downward movement of the platen and rods is against the bias of compression springs 46 around rods 42. The bottom ends of the springs are on the top of a fixed, elongated, horizontal member 17 forming part of support structure 14 and extending transversely of the structure. Member 17 is located at the top of a pair of upstanding support columns 15 (FIG. 4) above the upper platen. Springs 46 are trapped between support 17 and washers 48 on the upper end of rods 42, the washers being held in position by bolts 50 threaded into rods 42. Downward pressure on platen 14 thus will compress springs 46 against the bias thereof, this downward pressure being applied by an air actuator 54 mounted between support 17 and platen 40. Inflation of the air actuator by injection of air under pressure lowers upper platen 40 down onto lidded trays on tray holder 18. This actuator has a centrally positioned rod 55 engaging the top center of platen 40. Therefore, downward pressure of actuator 54 on rod 55 creates a balanced pressure by all portions of platen 40 against all portions of the tray and lid, since the platen can float to rock as necessary to always seek a parallel relationship to the support and a container flange and lid thereon. This creates uniform pressure on all parts of the flange and contacting lid areas. The upper platen includes a plurality of resistance heater elements 41 (FIG. 4), so that heat and pressure can be applied to the lid and the peripheral rim of the tray in cavity 34, to seal the lid to the tray container. Support 17 is mounted at one of its ends to one column 15 with a pivot pin 60 (FIG. 3), and at the other end to the other column 15 by a removable lock pin 62. Lock pin 62 extends through a pair of rigid mounting ears 64, as well as through the one end of support 17. Removal of the lock pin 62 allows support 17 and the upper platen to be pivoted laterally on pin 60 for cleaning, repair or the like. The lower support 18 is also removable for cleaning, substitution of a support with a different size and/or shape recess, or otherwise, simply by releasing the drawer rails in a conventional manner.

The frame structure also includes a pair of upper roller bars 70 extending transversely of the apparatus and parallel to each other, for mounting a roll R of interconnected lids thereon. These lids are separable along perforations (not shown) so that the operator can grasp the endmost portion of the roll, pull it beneath a retaining bar 72 and detach the end lid portion from the roll along the perforations, then place the lid on a container in cavity 34, and aligned within the pins 32. A friction brake on retaining bar 72 prevents the film from moving in reverse on the roll. These pins are depressible into support 18 when upper platen 40 is lowered by air actuator 54. The lids are normally of plastic material with a heat sealable layer, or a material such as paperboard coated with a heat sensitive sealable layer, to bond to the container flange when heated and pressed.

On the front end of tray support 18 is a rotational knob 43 for manual actuation to eject the finished tray from cavity 34 for grasping the tray. Specifically, by rotating knob 43, rod 92 and transverse element 90 are rotated, the latter engaging and lifting the tray. Also on the front face of tray support 18 is an upright protector panel 45 which closes adjacent the vertical panel on the front face of platen 40 when the support is moved inwardly to the sealing position, to close off the front face of the sealing apparatus and prevent injury to persons during vertical movement of heated upper platen 40.

Figure 6:
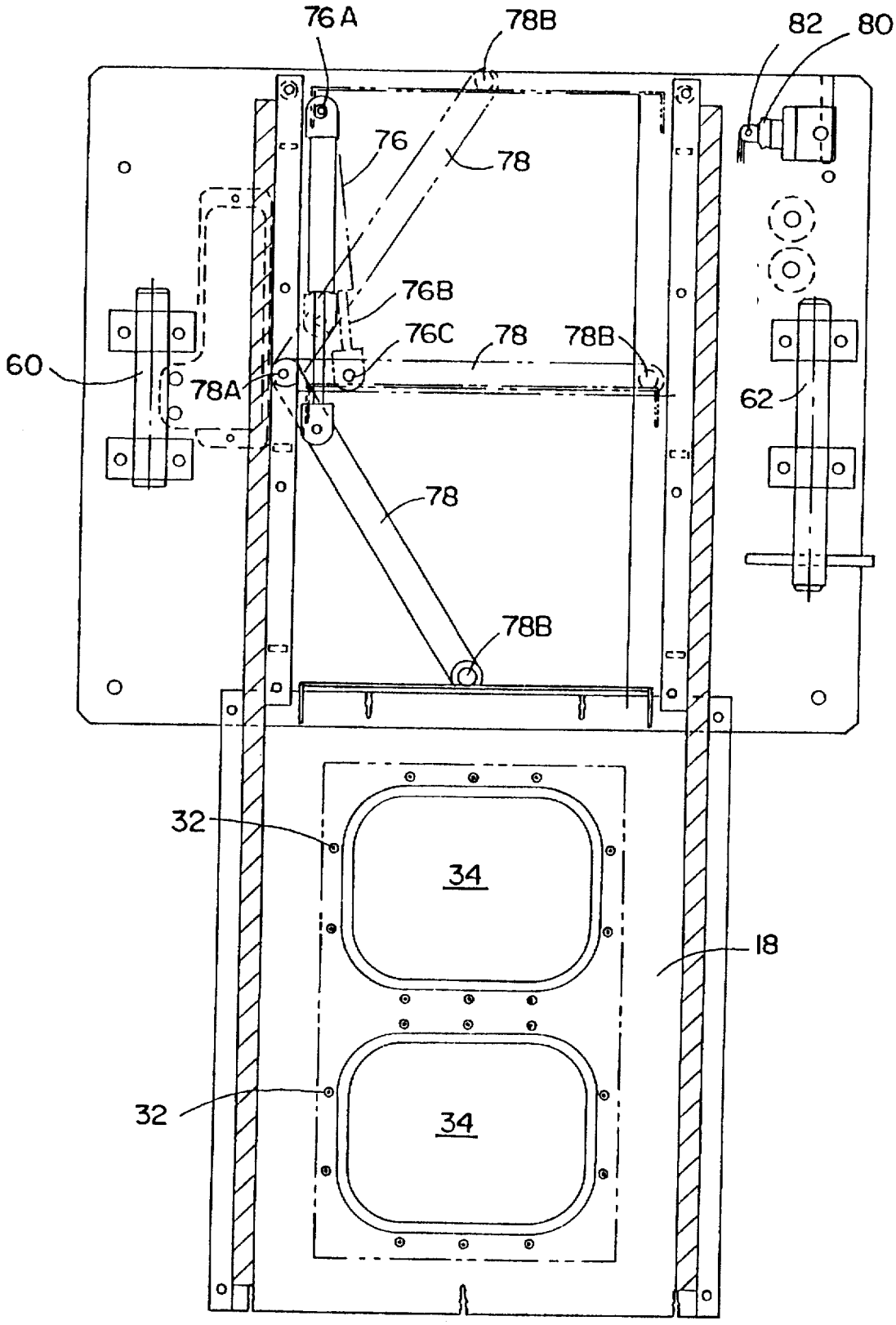
FIG. 6 is a sectional plan view of the apparatus.
Figure 8:
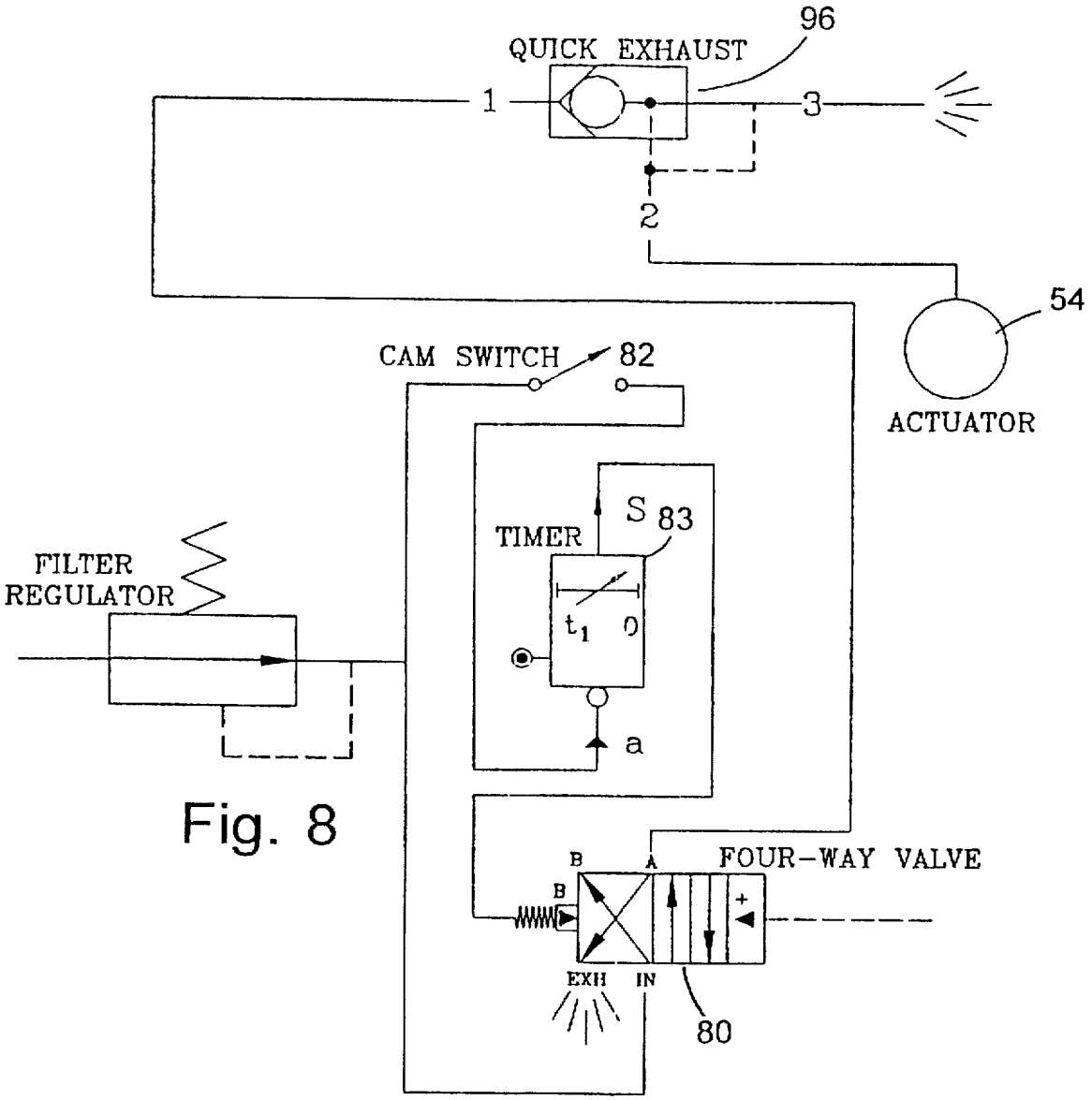
FIG. 8 is a schematic diagram of an air logic system for the apparatus.

A gas spring 76 for shifting the container support from its sealing position back to the extended load-unload position is attached between frame 14 and a pivotal link 78 (FIG. 6). More specifically, one end 76A of gas spring 76 is pivotally attached to frame 14, with the extended end of its piston rod 76B (FIG. 6) being pivotally connected at 76C intermediate the ends of link 78. One end of link 78 is pivotally connected at 78A to frame 14 while the opposite end 78B has a roller cam engaging tray support 18, such that extension of the gas spring shifts the link and tray support from the sealing position to the load-unload outer position, such movement being shown by the three successive positions depicted in FIG. 6.

Figure 7:
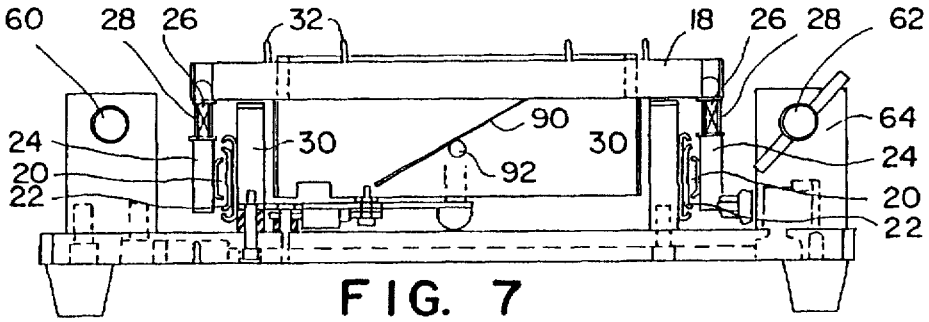
FIG. 7 is a front end elevational view of the lower portion of the apparatus.

Downward movement of air actuator 54 is controlled by opening of a valve 80 (FIG. 4) with a pneumatic cam valve switch 82 engaged by the inner end of one of the drawer supports 24 when the tray holder is moved into the sealing position. The force of air actuator 54 lowers upper platen 40 down against the container and lid on the tray support 18, forcing the lower platen down against the bias of springs 46 until it engages support beams 30. The time interval of actuation of the constant force air actuator 54 is controlled by a timer 83 (FIG. 7). At the end of this interval, timer 83 actuates a quick exhaust, i.e., air dump, valve 96 which instantly dumps the air from the air actuator 54 to immediately cause it to retract vertically upwardly under the bias of compression springs 46. Upon release of the downward pressure by the upper platen, gas spring 76 extends its piston rod to pivotally shift link 78 and thereby horizontally shift tray support 18 out of the sealing position to the extended load-unload position.

In operation, therefore, with the tray support in the extended load-unload position, a person places in cavity 34 an open top container having a peripheral flange (FIG. 1) to rest on the tray support. The container can be filled in place or can have contents already in it when so placed. The operator then pulls the end portion of roll R and separates the endmost lid from the roll, placing it on top of the container and flange, within the confines of pins 32. The lid and/or container flange have heat responsive sealing material thereon. The tray support, tray, contents and lid are then pushed into the sealing position, riding on the drawer rails. At this point the tray support engages cam 82 of pneumatic cam valve 80 to actuate the air logic system and cause air to enter air actuator 54. This lowers, i.e., depresses, the heated upper platen 40 against the bias of compression springs 46, down against the lid, container and tray support, forcing the tray support down against the bias of compression springs 28, onto the upper surfaces of rigid support beams 30. Heat and pressure are held for the preset time interval necessary to seal the lids to the containers. The air actuator causes a balancing of pressure to all portions of the tray flange and engaging lid by the floating, i.e., three dimensional rocking, action of the platen 40 beneath actuator 54. Upon timed release of the air actuator, compressed air is discharged from the actuator, the upper platen is vertically retracted by spring bias, allowing gas spring 76 to horizontally eject the tray support along with its sealed container and contents from the sealing position to the load-unload position. At this point, the container can be made to partially protrude above tray support 18 by manual rotation by the operator of knob 43 and thus element 90 (FIG. 7) on pivot shaft 92, enabling the operator to grasp the sealed container. The unit is then ready for reloading. The operation is quick, simple and easy to learn. The sides and front of the unit are provided with guards to prevent the operator's hands from entering the sealing position area. Although the apparatus has been largely described using a tray type flanged container, other containers than trays could be sealed.

Those skilled in this field could well consider other variations on this apparatus to suit a particular application. It is not intended that this invention be limited to this preferred embodiment which is set forth as illustrative of the invention, but that the invention be limited only by the scope of the appended claims and the equivalents thereto.

The embodiments of the invention in which an exclusive property or privilege is claimed are defined as follows.

What is claimed is:

1. A container and lid sealing apparatus comprising:

a frame including fixed beams;

a container support including a container receiver;

rails mounting said support for horizontal movement thereof in a plane above an upper surface of said fixed beams between a loading-unloading position and a sealing position where said support overlies said fixed beams;

said support being resiliently mounted to said rails to be depressible under vertical force for lowering said support onto said fixed beams;

an upper heater platen suspended above said support and beams; and an air actuator above said platen actuable to force said upper heater platen downwardly onto a container and lid on said support, to force said support down onto said fixed beams and seal a lid onto a container on said support.

2. The container and lid sealing apparatus in claim 1 including a cam switch positioned to be actuated by said support when moved to said sealing position, for controlled activation of said air actuator.

3. A container and lid sealing apparatus comprising:

a container support including a container receiver;

rails mounting said support for movement thereof between a loading-unloading position and a sealing position;

a frame including fixed beams at said sealing position;

said rails and support being depressible under vertical force for lowering said support onto said fixed beams;

an upper heater platen suspended above said support and beams;

an air actuator above said platen actuable to force said upper heater platen downwardly onto a container and lid on said support to force said support down onto said fixed beams and seal a lid onto a container on said support;

a cam switch positioned to be actuated by said support when moved to said sealing position, for controlled activation of said air actuator; and a gas spring connected between said frame and said support, and biasing said support toward said loading-unloading position for ejection of said support from said sealing position upon deactivation of said air actuator.

4. The container and lid sealing apparatus in claim 1 including springs biasing said support upwardly away from said beams upon release of said actuator force.

5. The container and lid sealing apparatus in claim 2 including an air logic system operably associated with said cam switch to cause pressurized air supply to said actuator upon arrival of said support in said sealing position, and comprising an air dump valve for subsequent quick exhaust of air from said actuator.

6. The container and lid sealing apparatus in claim 5 wherein said air logic system includes a timer for controlling the duration of said pressurized air supply to said actuator.

7. The container and lid sealing apparatus in claim 1 wherein said air actuator engages said platen centrally thereof in a manner to enable said platen to rock and seek a parallel condition to said support and a container flange and lid thereon.

8. The container and lid sealing apparatus in claim 4 wherein said beams are below said support.

9. A container and lid sealing apparatus comprising:

a frame including fixed beams;

a container support including a container receiver;

rails for allowing horizontal movement of said support in a plane above an upper surface of said fixed beams between a loading-unloading position and a sealing position where said support overlies said fixed beams;

biasing means for mounting said support to said rails while biasing said support away from said fixed beams, said biasing means allowing said support to be lowered onto said fixed beams under vertical force;

an upper heater platen suspended above said support and beams; and an air actuator above said platen actuable to force said upper heater platen down onto said support thereby lowering said support onto said fixed beams to seal a lid onto a container on said support.

* * * * *